US010437179B2

(12) United States Patent
Soures

(10) Patent No.: US 10,437,179 B2
(45) Date of Patent: Oct. 8, 2019

(54) SYSTEM AND METHOD FOR ADJUSTING OPERATION OF A TRANSFER ASSIST BLADE DRIVE TRAIN WITH REFERENCE TO PRINTING OPERATIONAL PARAMETERS

(71) Applicant: Xerox Corporation, Norwalk, CT (US)

(72) Inventor: Michael N. Soures, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/790,452

(22) Filed: Oct. 23, 2017

(65) Prior Publication Data

US 2019/0121262 A1 Apr. 25, 2019

(51) Int. Cl.
*G03G 15/16* (2006.01)
*G03G 15/00* (2006.01)

(52) U.S. Cl.
CPC ..... *G03G 15/1615* (2013.01); *G03G 15/165* (2013.01); *G03G 15/50* (2013.01)

(58) Field of Classification Search
CPC ..... G03G 15/1615
USPC ..... 399/66
See application file for complete search history.

(56) References Cited

U.S. PATENT DOCUMENTS 5,923,921 A * 7/1999 OuYang ..... G03G 15/6558 399/317
2005/0025536 A1 2/2005 Gross et al.
2007/0048034 A1 3/2007 Soures et al.
2007/0104519 A1* 5/2007 Soures ..... G03G 15/1695 399/316
2011/0249997 A1 10/2011 Robles-Flores
2012/0106992 A1 5/2012 Higgins et al.

* cited by examiner

*Primary Examiner* — David M. Gray
*Assistant Examiner* — Andrew V Do
(74) *Attorney, Agent, or Firm* — Maginot Moore & Beck LLP

(57) ABSTRACT

A printer includes a controller that operates an actuator of a transfer assist blade (TAB) mechanism with reference to an actuator profile. The actuator profile identifies an actuator waveform and a plurality of pulse trains for the actuator waveform. The actuator profile and the data associated with it are developed with reference to the drive train for the TAB mechanism. The actuator profiles enable the TAB mechanism drive train to achieve optimal operation over a wide range of media types, substrate speeds, pitch modes, and other print job parameters.

13 Claims, 18 Drawing Sheets

| | MOTOR PULSES | | | |
|---|---|---|---|---|
| | XC | FX | WHITLOCK | CAM |
| TOUCH DOWN (FROM HOME) | 32 | 62 | 49 | 38 |
| 100% TAB LOAD (FROM HOME) | 94 | 91 | 115 | 106 |
| LIFT OFF (FROM HOME) | 162 | 108 | 151 | 123 |
| RETURN STEPS TO HOME | 106 | 109 | 85 | 94 |
| TOTAL CYCLE | 200 | 200 | 200 | 200 |
| TAB DOWN PERIOD | 130 | 46 | 102 | 85 |
| TAB UP PERIOD | 70 | 154 | 98 | 115 |
| LIFT OFF (FROM DOWN) | 68 | 17 | 36 | 17 |
| TOUCH DOWN (FROM DOWN) | 138 | 171 | 134 | 132 |

SYSTEM AND METHOD FOR ADJUSTING OPERATION OF A TRANSFER ASSIST BLADE DRIVE TRAIN WITH REFERENCE TO PRINTING OPERATIONAL PARAMETERS

TECHNICAL FIELD

The present disclosure relates generally to a printing system, and, more specifically, to control of components that apply pressure to media in printing systems.

BACKGROUND

In high-speed reproduction machines, such as electrostatographic copiers and printers, a photoconductive member (or photoreceptor) is charged to a uniform potential and then a light image of an original document is exposed onto a photoconductive surface by a digital image driven laser. Exposing the charged photoreceptor to a light image discharges the photoconductive surface in areas corresponding to non-image areas in the original document while maintaining the charge on the image areas to produce an electrostatic latent image of the original document on the photoconductive surface of the photoreceptor. A developer material is then brought into contact with the surface of the photoconductive member to transform the latent image into a visible reproduction. The developer material includes toner particles with an electrical polarity opposite that of the photoconductive member, causing them to be attracted to the image on the photoconductive member. A blank print substrate, such as a sheet of paper, is brought into contact with the photoconductive member and the toner materials are transferred to it by electrostatic charging of the substrate. The substrate is subsequently heated and pressed to bond the reproduced image to the substrate permanently to produce a hard print reproduction of the original document or image. Thereafter, the photoconductive member is cleaned and reused for subsequent print production.

Various sizes of print substrates are typically stored in trays that are mounted at the side of the machine. In order to duplicate a document, a print substrate with the appropriate dimensions is transported from the appropriate tray into the paper path just ahead of the photoreceptor. The substrate is then brought into contact with the toner image on the surface of the photoconductive member prior to transfer. However, a registration mechanism typically intercepts the substrate in advance of the photoconductive member and either stops it or slows it down in order to synchronize the substrate with the image on the photoconductive member. The registration mechanism also properly aligns the print substrate in the process or longitudinal direction prior to delivery of the substrate to the photoconductive member. The registration mechanism also properly aligns the print substrate in the cross-process or lateral direction prior to delivery of the substrate to the photoconductive member.

The process of transferring charged toner particles from an image bearing member, such as the photoreceptive member, to an image support substrate, such as a print sheet, is accomplished at a transfer station. In a conventional electrostatographic machine, transfer is achieved by transporting an image support substrate into the area of the transfer station where electrostatic force fields sufficient to overcome the forces holding the toner particles to the photoconductive surface are applied to the substrate to attract and transfer the toner particles to the image support substrate. In general, such electrostatic force fields are generated by an electrostatic induction device, such as a corotron. The reverse side of the print sheet is exposed to a corona discharge while the front of the print sheet is placed in direct contact with the developed toner image on the photoconductive surface. The corona discharge generates ions having a polarity opposite that of the toner particles, thereby electrostatically attracting and transferring the toner particles from the photoreceptive image bearing member to the print sheet.

Unfortunately, the interface between the image bearing surface and the print sheet is not always optimal. Particularly, with non-flat print sheets, such as print sheets that have already passed through a fixing operation (e.g., heat or pressure fusing), perforated sheets, or sheets that are brought into imperfect contact with the charge retentive surface, the contact between the sheet and the image bearing surface may be non-uniform, which produces gaps where physical contact fails. The toner particles tend not to transfer across these gaps, causing a print quality defect referred to as transfer deletion.

The problem of transfer deletion has been addressed by various approaches. For example, mechanical devices that force the substrate into intimate and complete contact with the image bearing surface have been incorporated into transfer systems. Using this approach, transfer assist blades (TABs) have been configured for sweeping over the back side of the substrate at the entrance to the transfer region. The pressure applied by a TAB helps release toner from the image bearing surface to the substrate by holding the substrate flat in the electrostatic field. The transfer assist blade is typically moved from a non-operative position spaced from the substrate to an operative position where the TAB contacts the back of the substrate. A mechanism supporting the TAB is operable to press the TAB against the substrate with a pre-determined force sufficient to press the copy substrate into contact with the developed image on the photoconductive or other charged imaging surface. This pressure substantially eliminates any spaces between the substrate and the photoconductive member during the transfer process.

Control of the TAB movement is an important aspect of the image transfer operation. In printing systems in which the transfer substrates are cut sheets, no portion of the transfer assist blade should contact the photoreceptive member surface. Such contact may result in the pickup of residual dirt and toner from the charged photoconductive member surface to the transfer assist blade. Additionally, contact of the TAB with the charged photoreceptive member surface risks abrading the surface, thereby adversely affecting subsequent image quality and shortening the expected life of the expensive photoconductive member or other charged imaging surface. The spaces on the photoconductive member between images are known as inter-document zones (IDZs). Frequently, test patterns or other indicia are printed in these areas to evaluate the operational status of the components generating the images in the printing system and these test patterns are not transferred to the sheets. Thus, the TAB needs to move between the non-operative and operative positions in a manner that corresponds to the length of the images being transferred to the substrate without contacting the photoreceptive member in the IDZs.

Because the TAB is raised and lowered at the trailing edge and at the leading edge of the images, respectively, the configuration of the actuator and drive train moving the TAB is important. A high degree of accuracy is therefore required in timing engagement and disengagement of the TAB with the substrate. Such engagements and disengagements of the TAB are generally designed as timed sequences in relation to the substrate path speed and other related parameters. Some of the drive trains utilize cams that are rotated by the actuator to press the TAB into contact with the substrate. Other drive trains are configured with gears or links that are maneuvered by the actuator to move the TAB. Each different type of drive train has advantages for different print job parameters. For example, some provide quick TAB take-off from a trailing edge, while others apply TAB pressure sooner or more quickly than others.

The effects of these differences can be easily seen by the graph of the transfer functions shown in FIG. 9. This figure shows how four TAB drive trains respond differently to the same motor pulses due to differences in the drive train. The table shown below the graph quantifies the different responses. As shown in the figure, some drive trains enable the TAB to rotate into contact with the substrate quickly, while others lift the TAB from the substrate faster than the others. Likewise, some of the drive trains apply the full pressure of the TAB faster than other drive trains. These differences in drive train response to the actuator result in some drive trains being better for some types of substrates than for others. Incorporating all of the drive train configurations in a single printer and then selectively applying the drive trains to the TAB with reference to the substrate type is too expensive and requires additional space for the TAB mechanism.

Some printing parameters affect the effectiveness of the TAB on the transfer process. For example, printed images that have a substantial amount of marking material that will be placed near the leading edge of a sheet may be susceptible to smear, if the TAB lands at a rate or force that disturbs the sheet as the TAB encounters the sheet. To compensate for this issue, previously known systems delay the time that the TAB engages the sheet. While this adjustment may improve the transfer of the marking material near the leading edge, it may still result in sub-optimal transfer of the marking material since the sheet has no holding force against the sheet prior to the TAB touchdown. Additionally, this adjustment may not perform well with subsequent images that do not have as much marking material near the leading edge Similar issues occur at the trailing edge with regard to the position at which the TAB lifts from the sheet. While providing a plurality of drive trains in a printer and selectively coupling each one to the TAB to obtain the advantages of each one for particular print jobs might solve this issue, significant space would be required in the printer. Additionally, maintenance of so many drive trains would affect the reliability of the printer. Enabling TAB control to assist the transfer process more consistently over a wide range of print job parameters would be useful.

SUMMARY

A TAB mechanism is disclosed in this document that enables the response of a single drive train to an actuator to be modified with reference to printing parameters for a print job. The TAB mechanism includes a member, a drive train configured to move the member, an actuator operably connected to the drive train, and a controller operably connected to the actuator. The controller is configured to select an actuator profile stored in a memory operably connected to the controller with reference to at least one print job parameter, the actuator profile has a waveform for operating the actuator. The controller transmits a plurality of pulse trains to the actuator with reference to the selected actuator profile to rotate an output shaft of the actuator to operate the drive train and move the member.

A method of a TAB mechanism in a printer enables the drive train of the mechanism to move the blade with reference to printing parameters for a print job. The method of operation includes selecting with a controller an actuator profile stored in a memory operably connected to the controller with reference to at least one print job parameter, the actuator profile having a waveform for rotating an output shaft of an actuator to operate a drive train and move a member, and transmitting with the controller a plurality of pulse trains to the actuator with reference to the waveform of the selected actuator profile.

BRIEF DESCRIPTION OF THE DRAWINGS

Aspects and features of the present embodiments are presented in the following description and accompanying drawings.

DESCRIPTION

Figure 1:
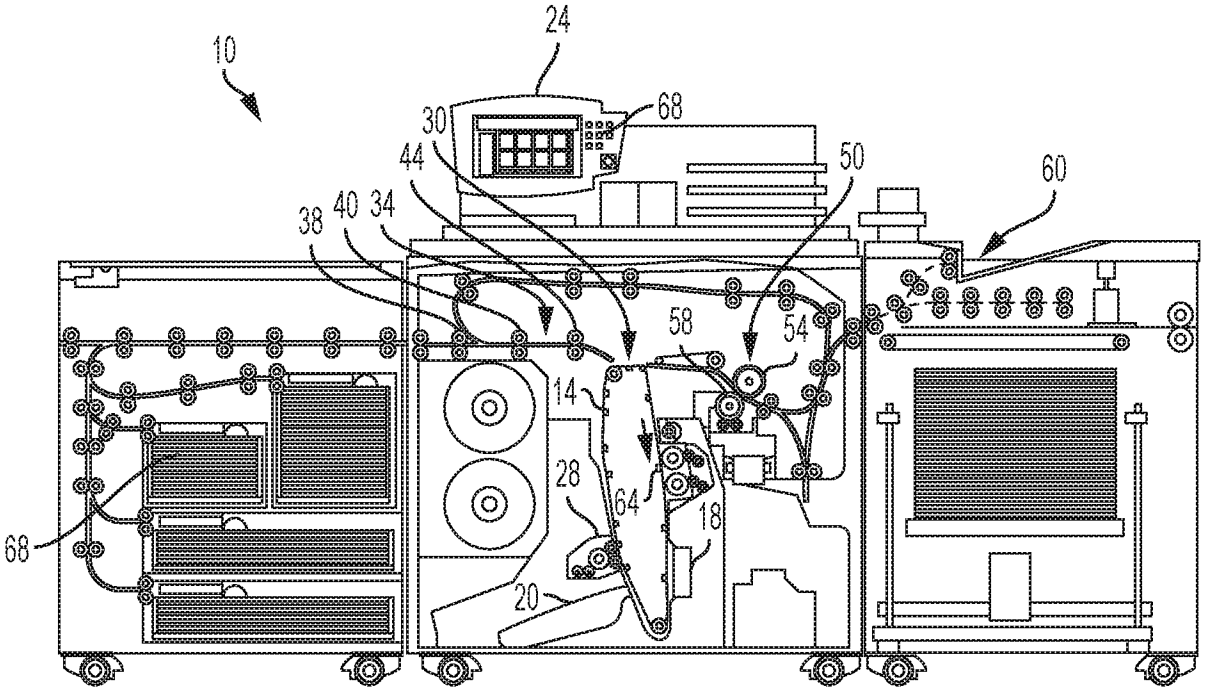
FIG. 1 is a schematic elevational view of an illustrative electrostatographic machine.

The system and method, described in more detail below, operate the TAB more consistently with reference to the parameters of each print job. This consistency occurs for a range of printing parameters without requiring a plurality of TAB drive trains. Other benefits and advantages of the system and method for drive train operation in a printing machine are apparent from the reading and understanding the following drawings and specification. In the drawings, like reference numerals have been used throughout to designate like elements.

An exemplary imaging system comprises a multifunctional printer with print and scan functions. Such multifunctional printers are well known in the art and may comprise print engines based upon liquid or solid inkjet, electrophotography, electrostatographic technologies, and other imaging technologies. An exemplary electrostatographic machine 10 is shown in FIG. 1. The machine 10 employs an image-retentive member, such as photoreceptor belt 14, which includes a photoconductive surface deposited on an electrically grounded conductive substrate. Photoreceptor 14 continuously travels the circuit depicted in the figure in the direction indicated by the arrow advancing successive portions of the photoconductive surface of the belt 14 through various processing stations, which are disposed about the belt path as described below. While a photoreceptor belt 14 is shown, other types of image-retentive members could be used, such as an anodized drum used in a color electrophotographic machine, offset printing apparatus, or inkjet printer.

Initially, a segment of belt 14 passes through charging station 18 where a corona generating device (not shown) or other charging apparatus charges photoreceptor belt 14 to a relatively high, substantially uniform potential. Once charged, the photoreceptor belt 14 is advanced to imaging station 20. At imaging station 20, a raster output scanner (ROS) (not shown) selectively discharges those portions of the charge on the belt 14 corresponding to the image portions of the document to be reproduced. In this way, an electrostatic latent image is recorded on the photoconductive surface. An electronic subsystem (ESS) (not shown) controls the ROS. The ESS is adapted to receive signals from a system controller 24 and transpose these signals into suitable signals for controlling the ROS so as to record an electrostatic latent image corresponding to the textual and graphical content of the document to be reproduced by the printing machine 10. Other types of imaging systems may also be used employing, for example, a pivoting or shiftable LED write bar or projection LCD (liquid crystal display) or other electro-optic display as the "write" source.

After the electrostatic latent image is recorded on photoconductive surface of belt 14, belt 14 advances to development station 28 where toner material is deposited onto the electrostatic latent image. In the development station 28, toner particles are mixed with carrier beads to generate an electrostatic charge between the particles and the beads so the toner particles cling to the carrier beads and form developing material. The developing material is brought into contact with the photoreceptor belt 14 so the latent image on the belt attracts the toner particles from the developing material to develop the latent image into a visible image on the belt. After the toner particles have been deposited onto the electrostatic latent image to produce the toner image, belt 14 becomes an image bearing support surface for advancing the developed image to transfer station 30. At transfer station 30, a print substrate 68 is moved from a media path 34 into contact with the developed toner image on the belt. The interface between the media path 34 and the transfer station 30 includes an apparatus for applying contact pressure to the back of the substrate as the front of the substrate engages belt 14 as described in more detail below.

A print substrate 68 is retrieved from a supply at the origin of the media path 34 by at least one roller pair, such as exemplary roller pairs 38, 40, 44 and 48 shown in the figure. The media path 34 laterally registers and deskews substrate 68 before the substrate 68 contacts the photoconductive surface of belt 14. Each roller pair consists of a drive roller backed by an opposing hard idler roll that define a nip region between them. While only single roller pairs are shown in the side view, preferably two roller pairs are provided at each location, one outboard and one inboard in the width direction of the substrate 68 (cross process direction). The drive rollers are driven by a drive mechanism (not shown), such as a drive motor operably coupled to the roller. Suitable coupling may be through a drive belt, pulley, output shaft, gear or other conventional linkage or coupling mechanism. The position, timing and velocity of the substrate are controlled by a registration controller 204 (see FIG. 2), which receives synchronizing signals from the system controller 24. After passing through transfer station 30, the substrate 68 is separated from the belt 14 and transported to a fusing station 50 (FIG. 1). The toner image on substrate 68 is fused onto the substrate 68 between fuser rollers 54 and 58 to permanently affix the toner image to substrate 68. After fusing, the print substrate 68 is advanced along the media path 34 to receiving tray 60 for subsequent removal by an operator. After the substrate 68 is separated from belt 14, residual developing material that adhered to the photoconductive surface of the belt 14 is removed from the belt by cleaning station 64 before the belt is recharged and the image producing process is repeated.

Figure 2:
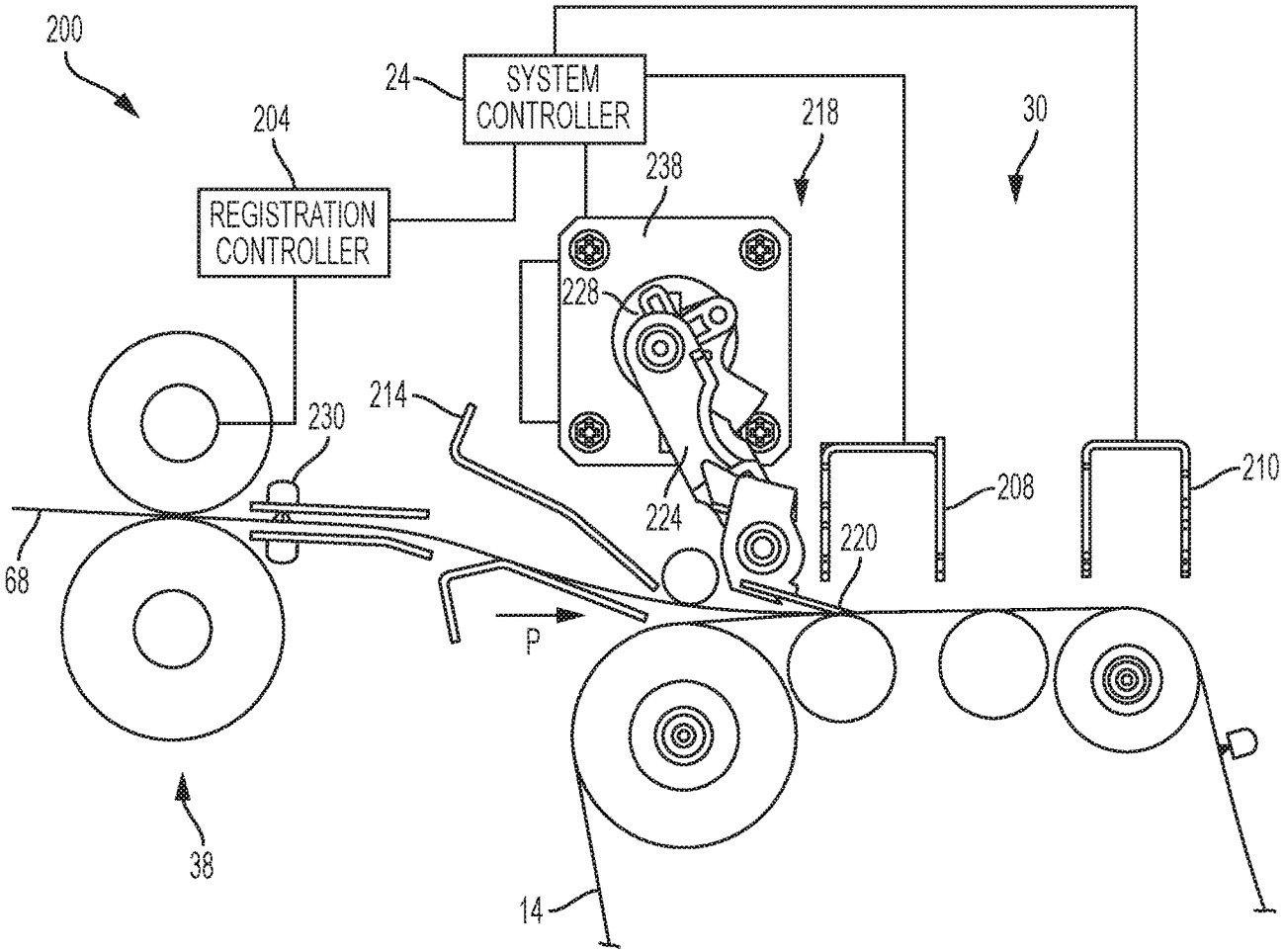
FIG. 2 is a schematic elevational view of a TAB mechanism for moving a TAB in the electrostatographic machine of FIG. 1.

With reference to FIG. 2, transfer station 30 includes a corona generating device 208, which charges the substrate to the proper magnitude and polarity for establishing a transfer field that is effective to attract the substrate 68 to photoconductive belt 14 so the developed image on the photoconductive belt 14 is adjacent the substrate 68. Thereafter, the substrate 68 moves with the photoconductive belt 14 in the process direction indicated by the arrow P. Apparatus 200 is a transfer assist blade mechanism that reduces transfer deletions between the substrate 68 and belt 14 in an electrostatographic machine. The apparatus 200 comprises a registration controller 204 that operates the media path 34 to synchronize the passing of the substrate 68 in the process direction P with the latent image on the belt 14 so the image can be transferred to the substrate 68. A system controller 24 is operably connected to the registration controller 204 and to an actuator 238 in drive train 218. The system controller 24 uses at least one operating parameter of a print job sent to the electrostatographic machine to select an actuator profile corresponding to the at least one operating parameter. The controller 24 uses the selected actuator profile to transmit pulses to the actuator 238 to control movement of a transfer assist blade 220 as well as the pressure applied by the blade 220. The at least one operating parameter can be received with a print job or it can be received from a user interface 68 (FIG. 1) when entered by an operator.

The drive train 218 shown in FIG. 2 includes a cam 228, which acts upon rotatable member 224, although other known drive trains include gears or combinations of cam and gears to manipulate the movement of blade 220 and the pressure applied by the blade. The system controller 24 determines the timing of the operation of the drive train 218 and the transfer assist blade 220 by selecting an actuator profile for operating the actuator 238 that controls the rotation of cam 228. The actuator profile is selected with reference to one or more print job parameters, the corresponding point of contact of the blade 220 with the leading edge of the substrate, and the corresponding liftoff point for the blade from the trailing edge of the substrate 68. The transfer assist blade 220 is beneficially comprised of an approximately 3 to 5 mil thickness of a non-conductive material and the blade is removably secured to rotatable member 224. A corona generator 208 is operated by the system controller 24 to assist in the image transfer process. After transfer of the latent image from the belt 14 to the substrate 68, the controller 24 operates a corona generator 210 to charge the print sheet 68 with an opposite polarity to detack the print sheet 68 to enable the sheet 68 to be stripped from belt 14.

The foregoing description should be sufficient for purposes of illustrating the general operation of an electrostatographic printing machine incorporating an embodiment of the transfer assist mechanism that modifies the operation of the actuator driving a transfer assist mechanism to consistently move and apply the TAB with reference to one or more print job parameters. As described, an electrostatographic printing machine may take the form of any of several well-known devices or systems. Variations of specific electrostatographic processing subsystems or processes may be expected without affecting the operation of the exemplary embodiment.

A number of operational parameters affect the effectiveness of a TAB to facilitate transfer of an image to a substrate and to ensure that the TAB does not contact the photoreceptive member in the IDZ between images on the member. One pair of important parameters is the speed of the substrate and the type of media being moved along the media path. The media type corresponds to the physical properties of the media, which includes the dimensions of the substrate. The process speed of the printer and the dimensions of the media are used to identify the location and length of the IDZ, the position where the TAB should be lifted from one media sheet, and the position where the TAB should touch down on the next media sheet. Other parameters that affect TAB operation are media weight and thickness of the media. Lighter weight or thinner media require the TAB to touch down close to the leading edge, but with a lighter pressure at first to help hold the media in contact with the photoreceptive member without disturbing the trajectory of the media, which smears the marking material at the leading edge of the image. Heavier and thicker media is less sensitive to variations in the contact pressure at the lead edge because the inherent stiffness prevents sheet stall or buckle under TAB loads. Variations in these parameters can cause a TAB mechanism to adversely affect the quality of a transferred image for a broad range of media types and images.

In order to operate a previously known TAB mechanism more consistently over a range of job parameters that could be addressed by selecting one drive train from a plurality of drive trains, a controller 24 has been operably connected to a memory having a lookup table that stores actuator profiles that correspond to different print job parameters. For example, a media type, substrate speed, and pitch configuration can identify an actuator profile that enables the TAB mechanism to manipulate the TAB in a manner that conforms the operation of the TAB to parameters of the print job. As used in this document, an "actuator profile" is a predetermined sequence of control pulses that conform to a predetermined waveform that operates the actuator to turn the output shaft at different speeds. The varying speed of the output shaft coupled with the configuration of the TAB drive train manipulates the TAB in a manner previously unknown. Thus, a known TAB drive train can be operated by the controller to manipulate the TAB consistently for a wide range of print job parameters. As used in this document, a pitch configuration and a pitch mode mean the spatial allocation of images and IDZs on a photoreceptive member or other imaging surface.

Figure 8A:
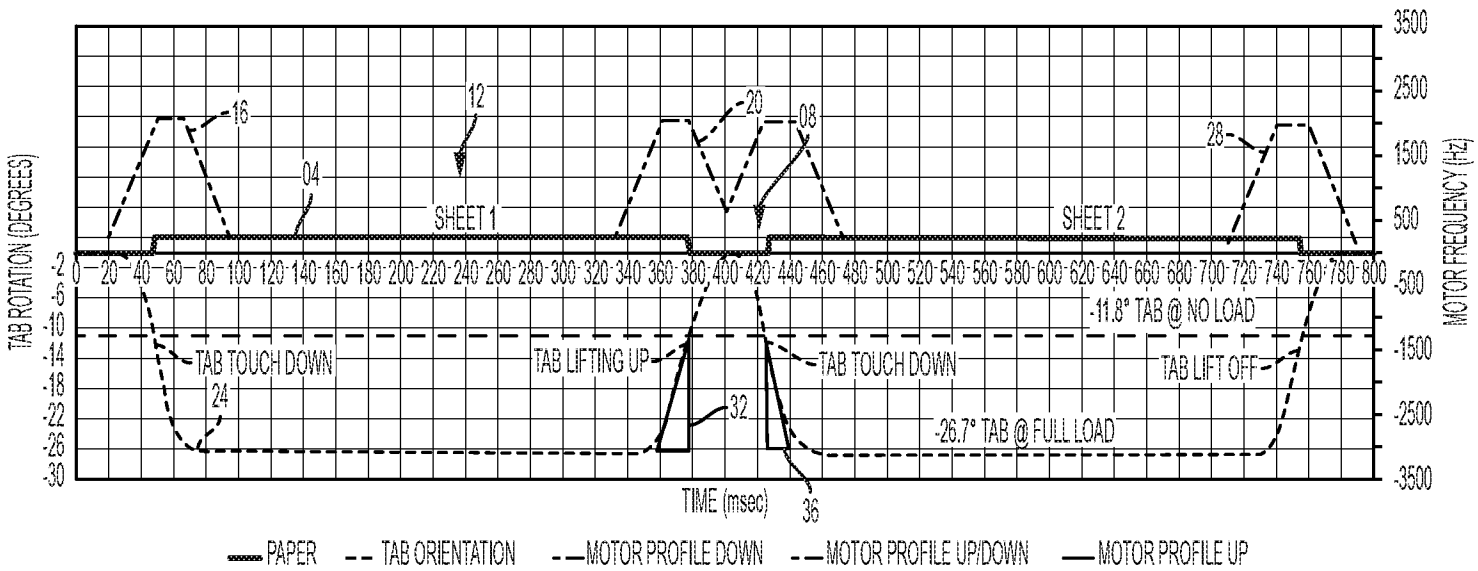
FIG. 8A PRIOR ART
FIG. 8A to FIG. 8C is a graph of a known normal mode of operation actuator profile delivered by a controller to an actuator in a known TAB mechanism and the rotation of the TAB with regard to a two sheet sequence.

Operation of a prior art TAB drive mechanism with a known controller is shown in FIG. 8A. The operation shown is for letter size paper traveling at 157 pages/minute (ppm), which means the IDZ between sheets is approximately 50 msec. The line 04 represents the presence or absence of a sheet in the transfer zone. The dip 08 in line 04 between sheet 1 and sheet 2 represents the IDZ between the two sheets as they pass through the transfer zone. Waveform 12 represents a known actuator profile for driving the actuator of the TAB mechanism. At the leading edge of the first sheet, pulse train 16 ramps up from a 200 Hz signal to a 2000 Hz signal until the loading approaches steady state. Then the pulse train goes back to the 200 Hz level and the motor stops moving until the next pulse train 20 is applied to the actuator. In response to pulse train 16, the TAB rotates to touch the leading edge of sheet 1 and continues to apply increasing pressure until a steady state at 100% of the TAB load is reached at point 24. As the trailing end of the sheet approaches, pulse train 20 is applied to the actuator to lift the TAB from the trailing end. The pulse train 20 ramps up from 200 Hz to 2000 Hz and then ramps down to an intermediate level of about 750 Hz in order to absorb the necessary motor pulses during the TAB up period for the current hardware implementation denoted as XC in FIG. 9. The pulse train 20 then ramps up to 2000 Hz, which rotates the TAB toward the leading edge of sheet 2 to engage the TAB with sheet 2 until the loading approaches steady state, the pulse train returns to the 200 Hz level, and the motor stops moving. Near the trailing edge of sheet 2, pulse train 28 is applied to lift the TAB from the sheet. In this implementation the rate at which the TAB is actuated is similar for both dropping the TAB and lifting the TAB so the TAB motion profile closely matches the transfer function for the XC mechanism shown in FIG. 9. The time taken for the TAB to lift or drop can be seen by the size of the base on triangles 32 and 36, respectively. The base of triangle 36 indicates that the rate of TAB application to sheet 2 is greater than the rate of TAB removal from sheet 1. The reader should note that the motor is only moving during the pulse trains 16, 20, and 28; and that the motor is always moving in response to pulse trains 16, 20, and 28. Pulse train 16 brings the TAB down, pulse train 20 brings the TAB up and then back down in one operation, and pulse train 28 lifts the TAB again at the last sheet. When these pulse trains are not actively being applied, the motor is on, holding its position, but otherwise not moving.

Figure 8B:
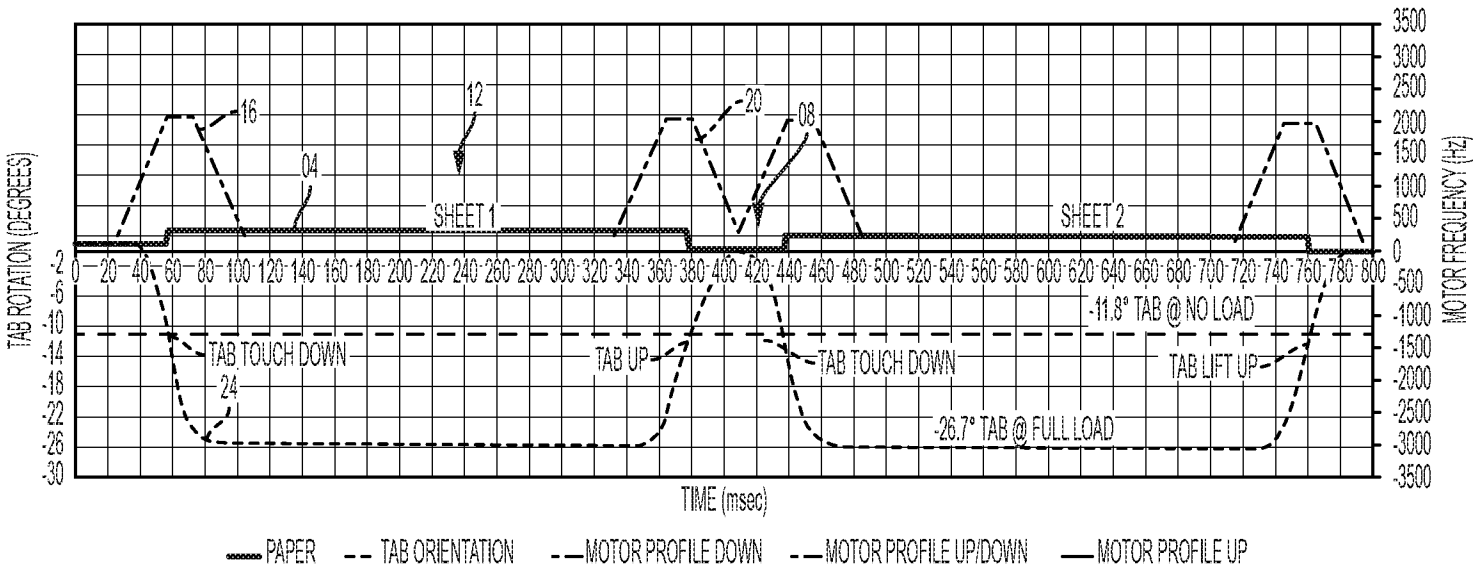
FIG. 8B PRIOR ART

Operation of the same prior art TAB drive mechanism by the known controller for another print job is shown in FIG. 8B. The operation is for A4 size paper traveling at 157 pages/minute (ppm), which means the IDZ between sheets is approximately 60 msec. The line 04 represents the presence or absence of a sheet in the transfer zone. The dip 08 in line 04 between sheet 1 and sheet 2 represents the IDZ between the two sheets as they pass through the transfer zone. Waveform 12 represents a known actuator profile for driving the actuator of the TAB mechanism. At the leading edge of the first sheet, pulse train 16 ramps up from a 200 Hz signal to a 2000 Hz signal until the loading approaches steady state, the pulse train returns to the 200 Hz level, where the motor stops moving until the next pulse train 20 is applied to the actuator. In response to pulse train 16, the TAB rotates to touch the leading edge of sheet 1 and continues to apply increasing pressure until a steady state is reached at point 24. As the trailing end of the sheet approaches, pulse train 20 is applied to the actuator to lift the TAB from the trailing end. The pulse train 20 ramps up from 200 Hz to 2000 Hz and then ramps down to the intermediate level of about 300 Hz. The pulse train 20 then ramps up to 2000 Hz, which rotates the TAB toward the leading edge of sheet 2 so the TAB engages with sheet 2 until the loading approaches steady state, the pulse train returns to the 200 Hz level, and the motor stops. Near the trailing edge of sheet 2, pulse train 28 is applied to lift the TAB from the sheet. The duration of the lower frequency near the midpoint of pulse train 20 enables the TAB to remain disengaged from the IDZ during the extended time the IDZ is present in this scenario.

Figure 8C:
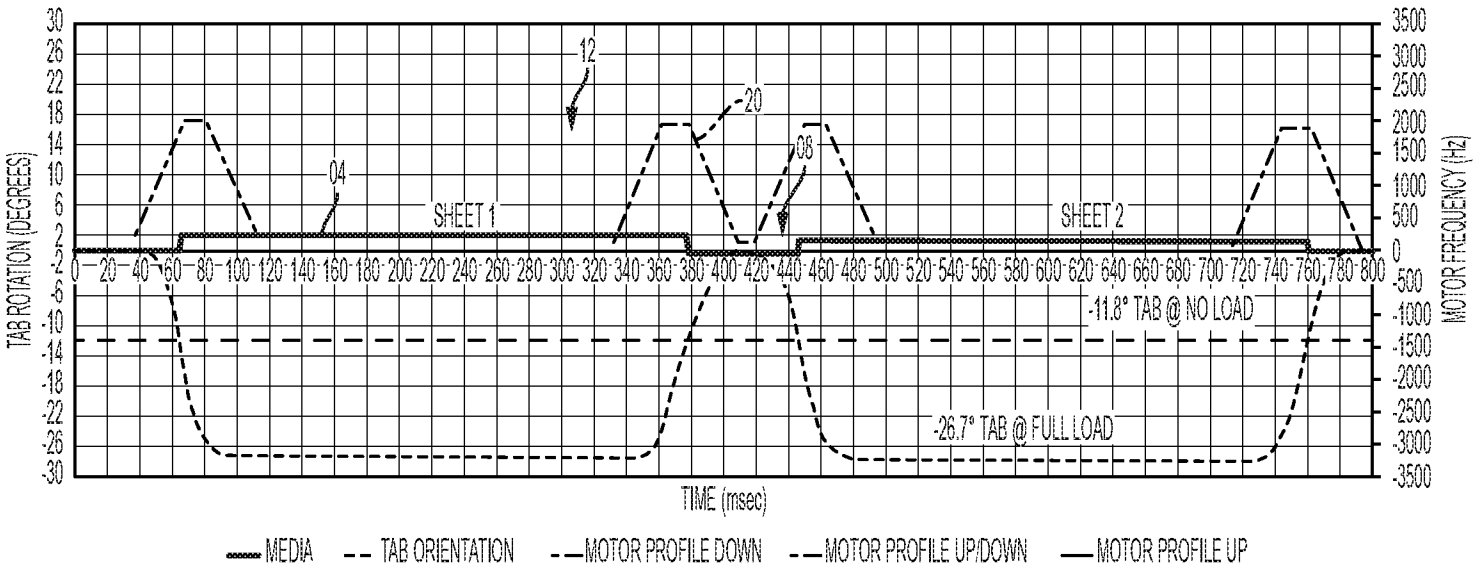
FIG. 8C PRIOR ART

Operation of the same prior art TAB drive mechanism with the known controller for another print job is shown in FIG. 8C. The operation is for 8"×10" size paper traveling at 157 pages/minute (ppm), which means the IDZ between sheets is approximately 70 msec. The line 04 represents the presence or absence of a sheet in the transfer mechanism. The dip 08 in line 04 between sheet 1 and sheet 2 represents the IDZ between the two sheets as they pass through the transfer zone. Waveform 12 represents a known actuator profile for driving the actuator of the TAB zone. At the leading edge of the first sheet, pulse train 16 ramps up from a 200 Hz signal to a 2000 Hz signal until the loading approaches steady state, where the pulse train returns to the 200 Hz level, and the motor stops moving until the next pulse train 20 is applied to the actuator. In response to the pulse train 16, the TAB rotates to touch the leading edge of sheet 1 and continues to apply increasing pressure until a steady state is reached at point 24. As the trailing end of the sheet approaches, pulse train 20 is applied to the actuator to lift the TAB from the trailing end. The pulse train 20 ramps up from 200 Hz to 2000 Hz and then ramps down to the intermediate level of about 300 Hz for a brief period. The pulse train 20 then ramps up to 2000 Hz, which rotates the TAB toward the leading edge of sheet 2 so the TAB engages with sheet 2 until the loading approaches steady state, the pulse train 20 then returns to 200 Hz, and the motor stops moving. Near the trailing edge of sheet 2, pulse train 28 is applied to lift the TAB from the sheet. The duration of the lower frequency near the midpoint of pulse train 20 enables the TAB to remain disengaged from the IDZ during the extended time the IDZ is present.

The alterations in the pulse train 20 shown in these figures help adjust the operation of the TAB mechanism for the changes in the IDZ depicted in the three figures. These IDZ changes arise from changes in the dimensions of the sheets. Other parametric changes can occur between print jobs as well. Some of these changes cannot be addressed by using the known waveform 12 even with duration and frequency modifications as was done in FIG. 8A to 8C. For example, as noted previously, printed images that have a substantial amount of marking material that will be placed near the leading edge of a sheet may be susceptible to smear, if the TAB lands at a rate or force that disturbs the sheet as the TAB encounters the sheet. To compensate for this issue, previously known systems delay the time that the TAB engages the sheet by shifting the pulse trains in the known waveform 12. While this adjustment may remove the disturbance of the marking material near the leading edge, it may still result in sub-optimal transfer of the marking material, known as image deletion, since the sheet has no mechanical assisting force that holds the sheet against the belt prior to the TAB touchdown. Additionally, this adjustment may not perform well with subsequent images that do not have as much marking material near the leading edge Similar issues occur at the trailing edge with regard to the position at which the TAB lifts from the sheet.

To enable a TAB mechanism to address a greater range of print job parameters, a TAB mechanism controller has been developed that consistently provides relatively quick TAB lift and stable TAB engagement with a range of TAB rotation rates to address image smears and deletions at the leading edge. This improvement is made possible by a new controller that has been operably connected to a memory having a lookup table that stores actuator profiles that correspond to different print job parameters. These actuator profiles change the shape of the waveform and the speeds sent to the actuator of the TAB mechanism. The goal for the TAB lift off is for the event to always happen as soon as possible, without subjecting the motor to stall conditions; and ideally for the lift off to occur at some known dwell frequency. The goal for stable TAB engagement is for the TAB touchdown to always occur at a known dwell frequency, or mechanism speed, so that image quality at the leading edge is more robust and repeatable. Use of these profiles adjust the rate of TAB rotation and the rate of TAB pressure application without significantly altering the landing and take-off points for the TAB as shown in FIG. 3A to FIG. 5C. Rather than adding alternative TAB drive systems and operating them selectively for different print jobs as described above, the same outcome can be achieved by using a parametric controller, which functions as a virtual drive train, to drive only one hardware configuration.

Figure 3A:
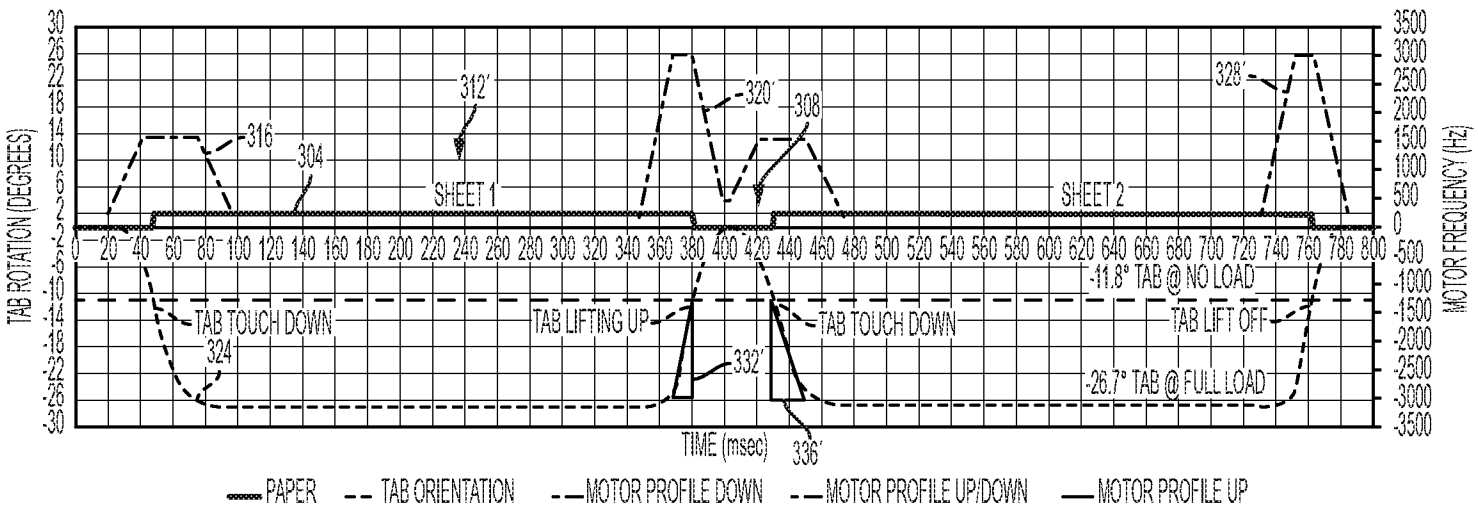
FIG. 3A to FIG. 3C is a graph of a new normal mode of operation actuator profile delivered by a controller to an actuator in a known TAB mechanism and the rotation of the TAB with regard to a two sheet sequence.

Operation of the same prior art TAB drive mechanism used in the scenarios of FIG. 8A to 8C with the new and improved parametric controller for the print job shown in FIG. 8A is depicted in FIG. 3A. The operation is for letter size paper traveling at 157 pages/minute (ppm), which means the IDZ between sheets approximately 50 msec. The line 304 represents the presence or absence of a sheet in the transfer zone. The dip 308 in line 304 between sheet 1 and sheet 2 represents the IDZ between the two sheets as they pass through the transfer zone. Waveform 312' represents a new actuator profile for driving the actuator of the TAB mechanism. At the leading edge of the first sheet, pulse train 316 ramps up from a 200 Hz signal to a 1600 Hz signal until the loading approaches steady state where the pulse train returns to the 200 Hz level and the motor stops moving until pulse train 320 is applied to the actuator. In response to pulse train 316, the TAB rotates to touch the leading edge of sheet 1 and continues to apply increasing pressure until a steady state is reached at point 324. As the trailing end of the sheet approaches, pulse train 320' is applied to the actuator to lift the TAB from the trailing end. The pulse train 320' ramps up from 200 Hz to 3000 Hz and then ramps down to the intermediate level of about 500 Hz for a brief duration. Then the pulse train 320' ramps up to 1600 Hz, which rotates the TAB toward the leading edge of sheet 2 so the TAB engages with sheet 2 until the loading approaches steady state, the pulse train 320' returns to the 200 Hz level, and the motor stops moving. Near the trailing edge of sheet 2, pulse train 328 is applied to lift the TAB from the sheet. This pulse train ramps up to 3000 Hz and, after a brief duration, returns to 200 Hz until TAB is in the up or home position and the motor stops moving. In comparison to FIG. 8A to 8C, the waveform 312 and its pulse trains not only adjust TAB operation for the IDZ, but they use information about the physical system XC shown in FIG. 9 to ensure that the lift off points and the landing points for the TAB occur at specific rates or mechanism speeds. Testing of the parametric controller and the waveforms that it uses show that the speed or rate of the TAB actuation during key transition points, such as TAB up or TAB down, are important parameters to manage. This management is achieved by actively changing both the dwell frequencies and the acceleration/deceleration rates for the TAB lift and the TAB drop to optimize the system response for both IDZ and print quality.

The rate of TAB rotation is visually indicated by the size of the bases of the triangles 332' and 336'. The size of the base of the triangle 336' indicates that the rate of TAB application to sheet 2 (longer duration) is less than the rate of TAB removal from sheet 1 (shorter duration). These rates are the opposite of those shown in FIG. 8A. Thus, the operation of the TAB mechanism has been changed by the waveform 312' and the pulse train 320' in particular to get the TAB off the trailing edge faster or in less time to avoid the IDZ and to apply the TAB to the leading edge of sheet 2 over a longer period of time without changing the point of contact on the sheet between the operation shown in FIGS. 8A and 3A. This quicker TAB take-off and the longer application of the TAB on landing is made possible by the asymmetrical form of pulse train 320'.

Figure 3B:
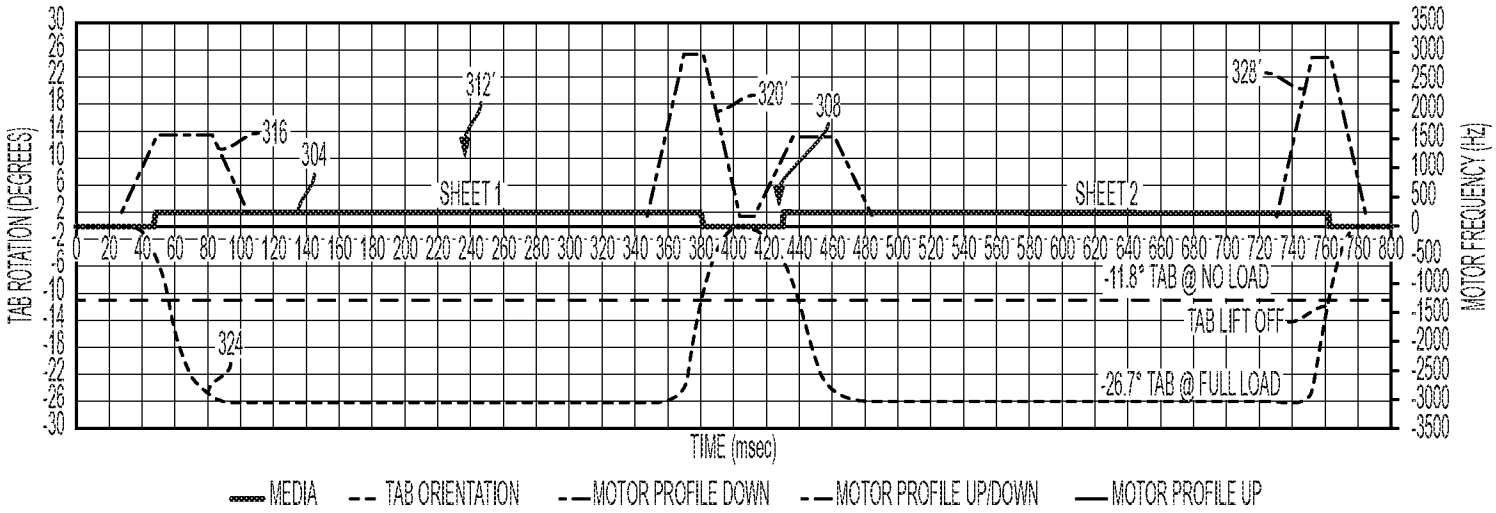

Operation of the same prior art TAB drive mechanism used in FIG. 8B with the new and improved controller for the print job shown in FIG. 8B is depicted in FIG. 3B. The operation is for A4 size paper traveling at 157 pages/minute (ppm), which means the IDZ between sheets is approximately 60 msec. The line 304 represents the presence or absence of a sheet in the transfer zone. The dip 308 in line 304 between sheet 1 and sheet 2 represents the IDZ between the two sheets as they pass through the transfer zone. Waveform 312' represents a new actuator profile for driving the actuator of the TAB mechanism. At the leading edge of the first sheet, pulse train 316 ramps up from a 200 Hz signal to a 1600 Hz signal until the loading approaches steady state where the pulse train 316 returns to the 200 Hz level, and the motor stops moving until pulse train 320 is applied to the actuator. In response to pulse train 316, the TAB rotates to touch the leading edge of sheet 1 and continues to apply increasing pressure until a steady state is reached at point 324. As the trailing end of the sheet approaches, pulse train 320' is applied to the actuator to lift the TAB from the trailing end. The pulse train 320' ramps up from 200 Hz to 3000 Hz and then ramps down to the intermediate level of about 200 Hz for a brief duration. Then the pulse train 320' ramps up to 1600 Hz, which rotates the TAB toward the leading edge of sheet 2 so the TAB engages with sheet 2 until the loading approaches steady state where the next pulse train 320' ramps down to 200 Hz and the motor stops moving. Near the trailing edge of sheet 2, pulse train 328 is applied to lift the TAB from the sheet. This pulse train ramps up to 3000 Hz and, after a brief duration, returns to 200 Hz. The trough in pulse train 320' extends down to 200 Hz to accommodate the wider IDZ without disturbing the take-off and landing positions of the TAB or the rate of take-off and landing. Thus, the operation of the TAB mechanism has been changed by the waveform 312' and the pulse 320' in particular to get the TAB off the trailing edge in time to avoid the IDZ and to apply the TAB to the leading edge of sheet 2 over a longer period of time without changing the point of contact on the sheet between the operation shown in FIGS. 8B and 3B. This quicker TAB take-off and the longer application of the TAB on landing is made possible by the asymmetrical form of pulse train 320' and the further extension of the trough in the middle of the pulse train 320'.

Figure 3C:
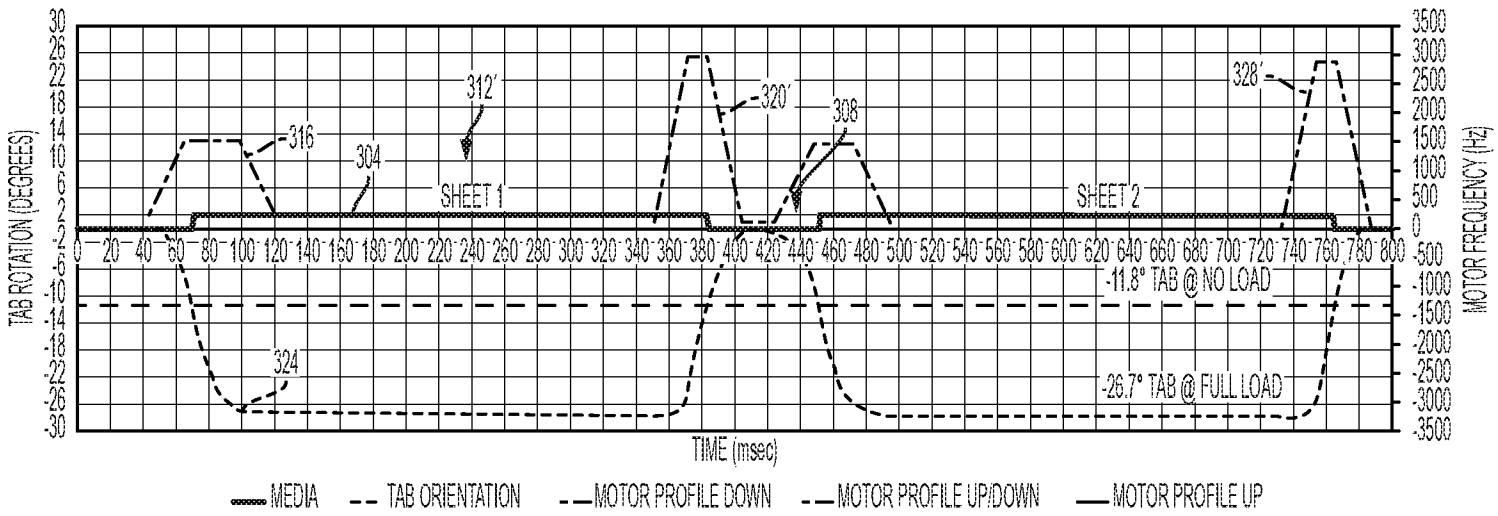

Operation of the same prior art TAB drive mechanism used in FIG. 8C with the new and improved controller for the print job shown in FIG. 8C is depicted in FIG. 3C. The operation is for 8"×10" size paper traveling at 157 pages/minute (ppm), which means the IDZ between sheets is approximately 70 msec. The line 304 represents the presence or absence of a sheet in the transfer zone. The dip 308 in line 304 between sheet 1 and sheet 2 represents the IDZ between the two sheets as they pass through the transfer zone. Waveform 312' represents a new actuator profile for driving the actuator of the TAB mechanism. At the leading edge of the first sheet, pulse train 316 ramps up from a 200 Hz signal to a 1600 Hz signal until the loading approaches steady state where the pulse train 316 returns to the 200 Hz level and the motor stops moving until the next pulse train 320' is applied to the actuator. In response to pulse train 316, the TAB rotates to touch the leading edge of sheet 1 and continues to apply increasing pressure until the desired steady state is reached at point 324. As the trailing end of the sheet approaches, pulse train 320' is applied to the actuator to lift the TAB from the trailing end. The pulse train 320' ramps up from 200 Hz to 3000 Hz and then ramps down to approximately 200 Hz for a brief duration. Then the pulse train 320' ramps up to 1600 Hz, which rotates the TAB toward the leading edge of sheet 2 so the TAB engages with sheet 2 until the loading approaches steady state where the pulse train 320' ramps down to 200 Hz and the motor stops moving. Near the trailing edge of sheet 2, pulse train 328 is applied to lift the TAB from the sheet. This pulse train ramps up to 3000 Hz and, after a brief duration, returns to 200 Hz. Thus, the operation of the TAB mechanism has been changed by the waveform 312' and the pulse 320' in particular to get the TAB off the trailing edge in time to avoid the IDZ and to apply the TAB to the leading edge of a sheet over a longer period of time without changing the point of contact on the sheet between the operation shown in FIGS. 8C and 3C. This quicker TAB take-off and the longer application of the TAB on landing is made possible by the asymmetrical form of pulse train 320' as well as the duration and amplitude of the trough in the middle of the pulse train 320'.

Figure 4A:
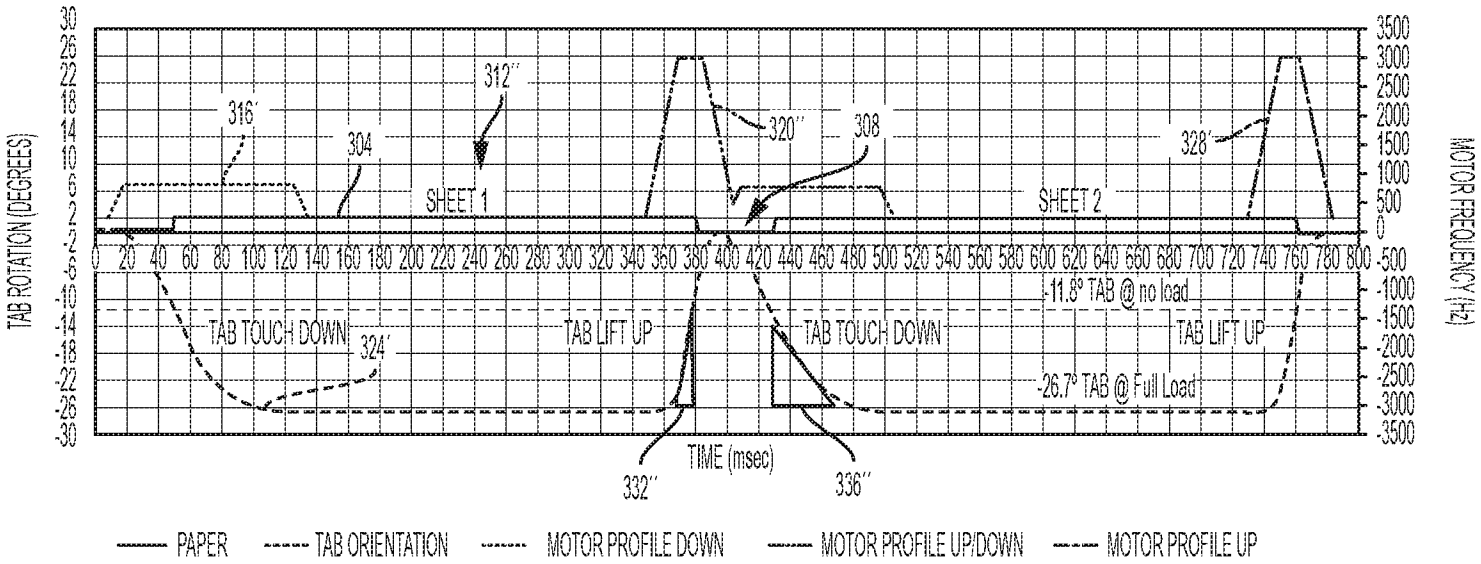
FIG. 4A to FIG. 4C is a graph of a new leading edge smear mode of operation actuator profile delivered by a controller to an actuator in a known TAB mechanism and the rotation of the TAB with regard to a two sheet sequence.

Operation of the prior art TAB drive mechanism used in FIG. 8A with the new and improved controller is depicted in FIG. 4A. The operation is for letter size paper traveling at 157 pages/minute (ppm), which means the IDZ between sheets is approximately 50 msec. Additionally, the amount of marking material in the image near the leading edge has been detected as being greater than a predetermined threshold. Consequently, the controller operates the TAB mechanism in a leading-edge smear optimization (LE Smear) mode. The line 304 represents the presence or absence of a sheet in the transfer zone. The dip 308 in line 304 between sheet 1 and sheet 2 represents the IDZ between the two sheets as they pass through the transfer zone. Waveform 312" represents a new actuator profile for driving the actuator of the TAB mechanism in this mode. At the leading edge of the first sheet, pulse train 316' ramps up from a 200 Hz signal to an 800 Hz signal until the loading approaches steady state where the pulse train returns to the 200 Hz level and the motor stops moving until pulse train 320" is applied to the actuator. This pulse train 316' does not ramp up to a speed as high as the one in pulse train 316, but the duration of the train is significantly longer. In response to pulse train 316', the TAB rotates to touch the leading edge of sheet 1 and continues to apply increasing pressure until a steady state is reached at point 324'. As can be seen from the figure, the application of pressure through the TAB takes longer, although contact with the sheet by the TAB occurs at about the same position as it did in FIG. 3A. The application of the TAB pressure over a longer period of time helps prevent smear. As the trailing end of the sheet approaches, pulse train 320" is applied to the actuator to lift the TAB from the trailing end. The pulse train 320" ramps up from 200 Hz to 3000 Hz and then ramps down to an intermediate level of about 500 Hz for a very brief duration. Then pulse train 320" moves up to 800 Hz and continues for a period of time that enables the TAB to be applied more slowly to the leading edge of sheet 2 before ramping down to 200 Hz and holding its position. Near the trailing edge of sheet 2, pulse train 328' is applied to lift the TAB from the sheet. This pulse train ramps up to 3000 Hz and, after a brief duration, returns to 200 Hz. The rate of TAB rotation is indicated by the sizes of the bases of the triangles 332" and 336". The size of the base of the triangle 336" indicates that the rate of TAB application to sheet 2 is less than the rate of TAB application shown by the size of the base of the triangle 336' in FIGS. 3A and 8A without significantly altering the take-off rate at the end of sheet 1 in these scenarios. Thus, the operation of the TAB mechanism has been changed by the waveform 312" and the pulse 320" in particular to apply the TAB to the leading edge of sheet 2 over a period of time that is longer than the period of landing in FIGS. 3A and 8A without changing the point of contact on the sheet between the operation shown in FIGS. 3A and 4A. This longer landing of the TAB is made possible by the change in pulse train 316' for sheet 1 and also by the change in the latter portion of pulse train 320" for all subsequent sheet so the landing position of the TAB on each following sheet is preserved.

Figure 4B:
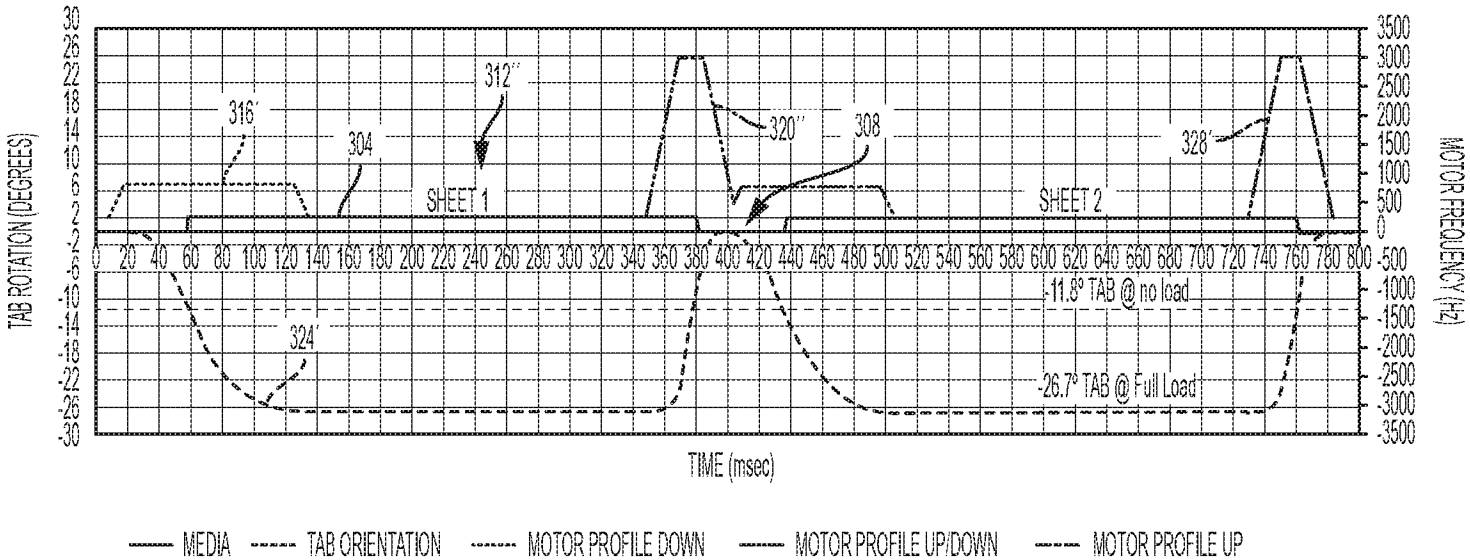
Figure 4C:
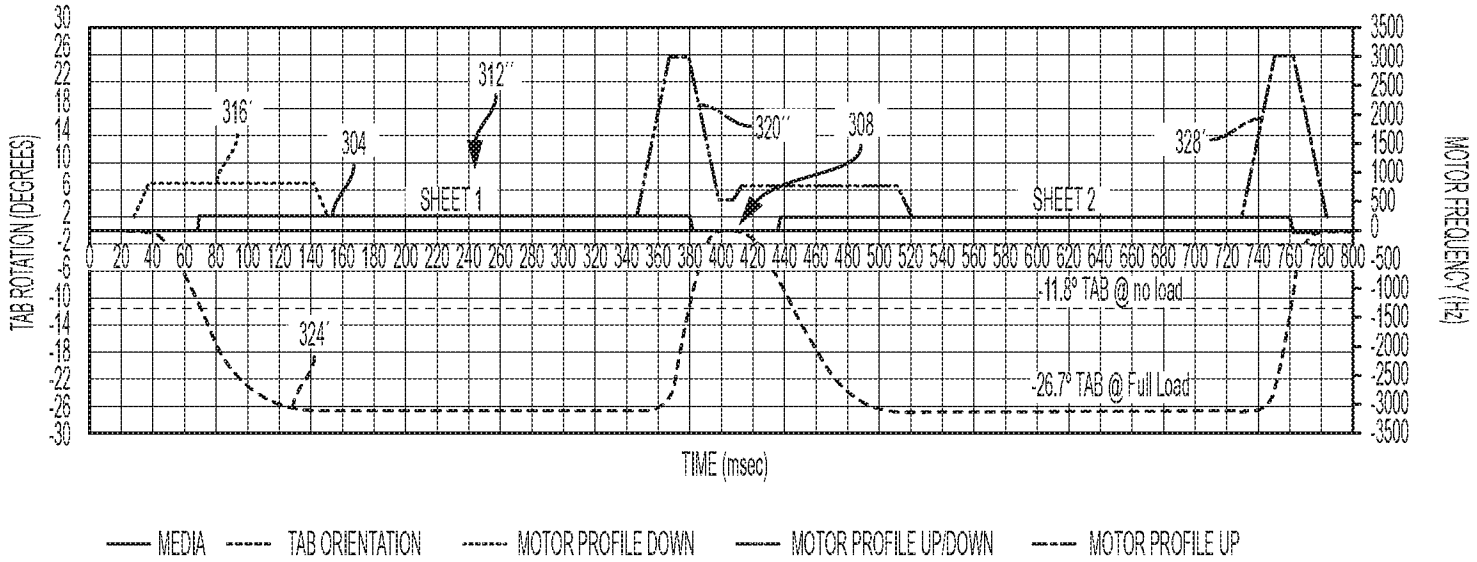

FIG. 4B and FIG. 4C show the new controller operating the actuator in the prior art TAB mechanism used in FIGS. 8B and 8C in the LE smear optimization mode for A4 size paper and 8"×10" size paper at a speed of 157 ppm. The pulse trains forming waveform 312" are similar to those shown in FIG. 4A with the following exceptions. In FIG. 4B, the dip in pulse train 320" holds the TAB off the longer IDZ and commences the application of the TAB on sheet 2 later. Similarly, the pulse train 320" in FIG. 4C holds the TAB off for an even longer IDZ while preserving the landing position of the TAB on sheet 2 at the slower rate of the LE smear optimization mode.

Figure 5A:
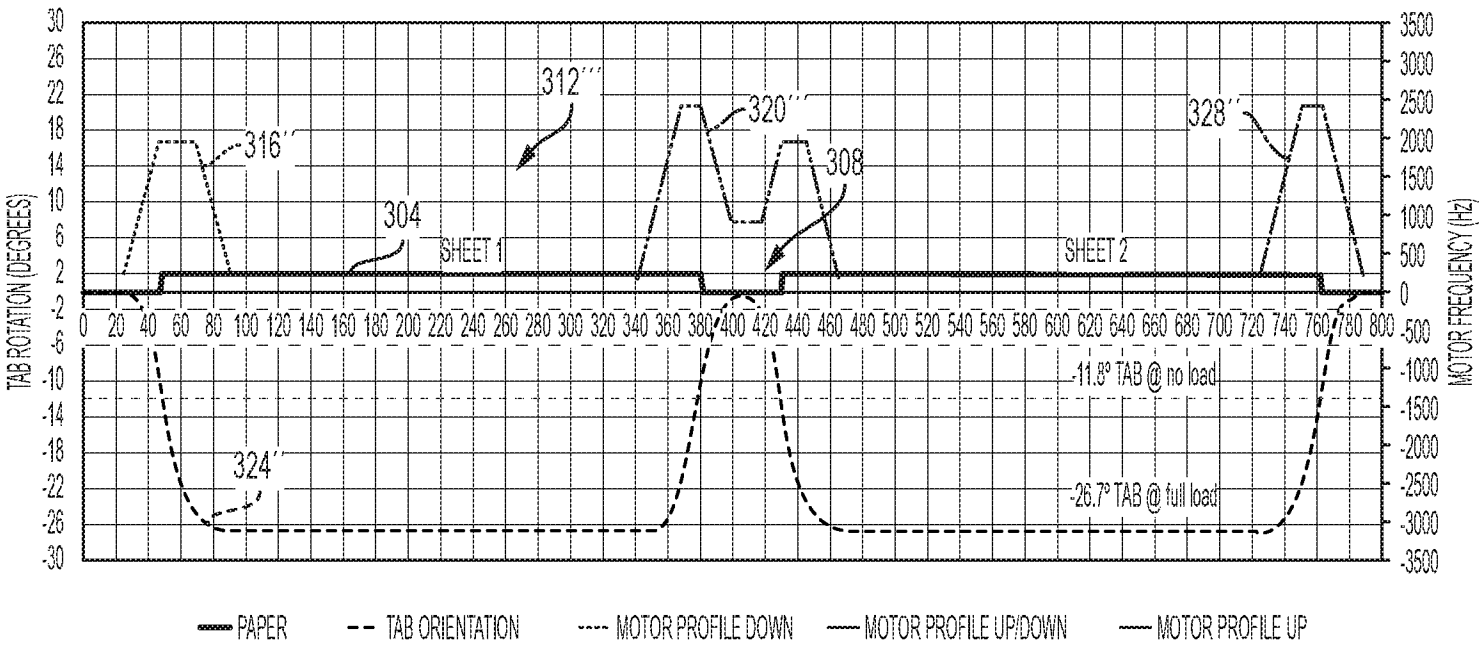
FIG. 5A to FIG. 5C is a graph of a new leading edge deletion mode of operation actuator profile delivered by a controller to an actuator in a known TAB mechanism and the rotation of the TAB with regard to a two sheet sequence.

Operation of the prior art TAB drive mechanism used in FIG. 8A with the new and improved controller is depicted in FIG. 5A. The operation is for letter size paper traveling at 157 pages/minute (ppm), which means the IDZ between sheets is present for approximately 50 msec. Additionally, the amount of marking material in the image near the leading edge has been detected as being less than a predetermined threshold. Consequently, the controller operates the TAB mechanism in a leading-edge deletion optimization (LE Deletion Optimization) mode. The line 304 represents the presence or absence of a sheet in the transfer zone. The dip 308 in line 304 between sheet 1 and sheet 2 represents the IDZ between the two sheets as they pass through the transfer zone. Waveform 312'" represents a new actuator profile for driving the actuator of the TAB mechanism. At the leading edge of the first sheet, pulse train 316" ramps up from a 200 Hz signal to a 2000 Hz signal and then back down to the 200 Hz level until the steady state TAB load is applied and the motor stops moving until the next pulse train 320'" is applied to the actuator. This pulse train 316" ramps up to a speed higher than the one in pulse train 316 to enable the TAB to be fully loaded against the leading edge more quickly. In response to pulse train 316", the TAB rotates to touch the leading edge of sheet 1 and continues to apply increasing pressure until a steady state is reached at point 324". As can be seen from the figure, the application of pressure through the TAB is quicker, although contact with the sheet by the TAB occurs at about the same position as it did in FIG. 3A. The application of the TAB pressure at the leading edge more quickly helps prevent image deletion. As the trailing end of the sheet approaches, pulse train 320'" is applied to the actuator to lift the TAB from the trailing end. The pulse train 320'" ramps up from 200 Hz to 2400 Hz and then ramps down to an intermediate level of about 1000 Hz for a very brief period until pulse train 320'" moves up to 2000 Hz and continues for a period of time that enables the TAB to be applied more quickly to the next sheet than was possible in the nominal or LE smear modes shown in FIGS. 3A and 4A. The pulse train 320'" then ramps down to 200 Hz and holds this position during the body of sheet 2. Near the trailing edge of sheet 2, pulse train 328" is applied to lift the TAB from the sheet. This pulse train ramps up to 2400 Hz and, after a brief duration, returns to 200 Hz. As can be seen from the figure, the rate of TAB application to sheet 2 is greater than the rate of TAB application shown in FIG. 3A or FIG. 4A without significantly altering the take-off rate at the end of sheet 1 in both scenarios. Thus, the operation of the TAB mechanism has been changed by the waveform 312'" and the pulse 320'" in particular to apply the TAB to the leading edge of sheet 2 more quickly than the TAB pressure is applied in FIG. 3A and FIG. 4A without changing the point of contact on the sheet between the operation shown in FIGS. 3A and 4A. This quicker landing of the TAB is made possible by the change in the latter portion of pulse train 320" that also preserves the landing position of the TAB on sheet 2.

Figure 5B:
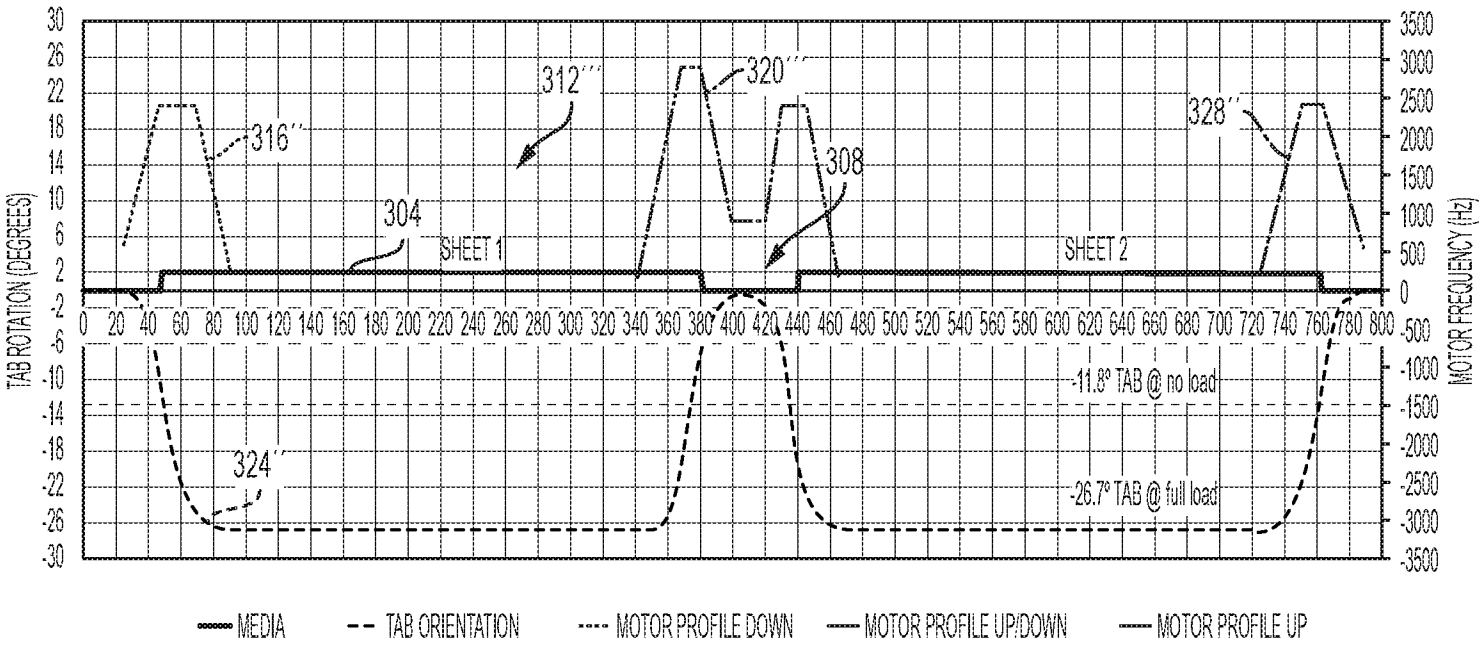
Figure 5C:
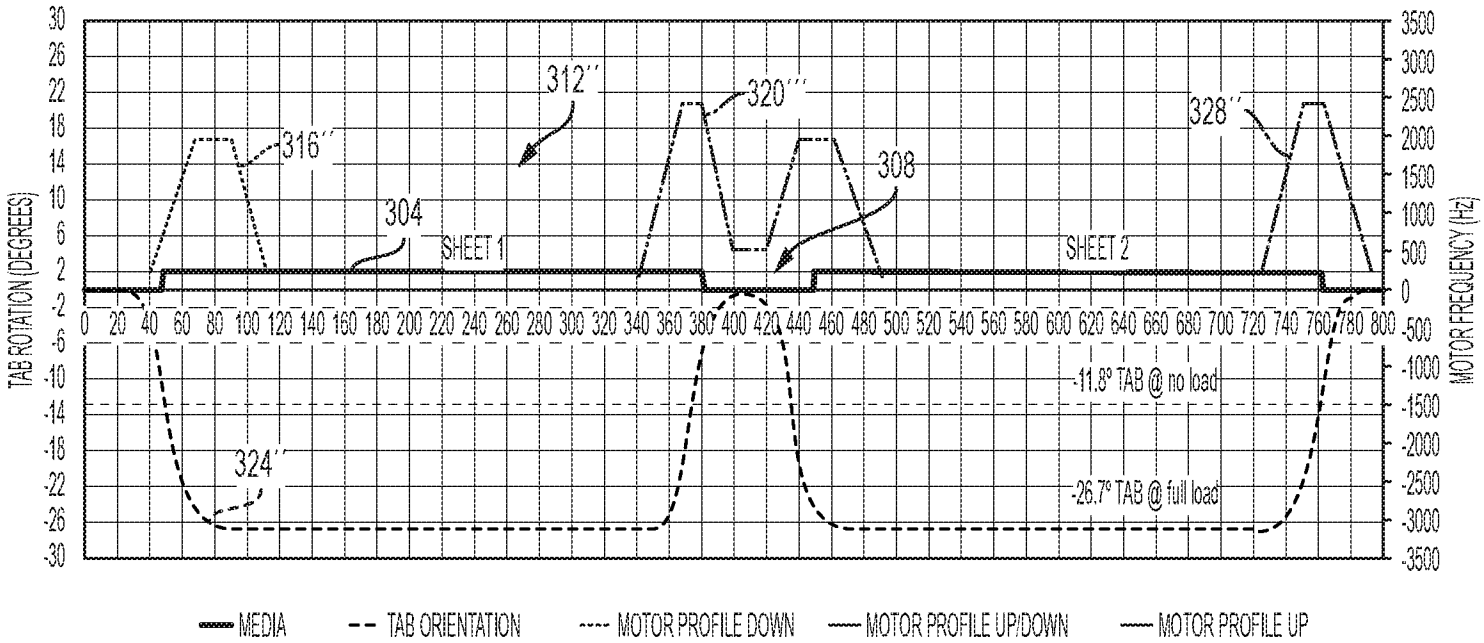
Figure 6A:
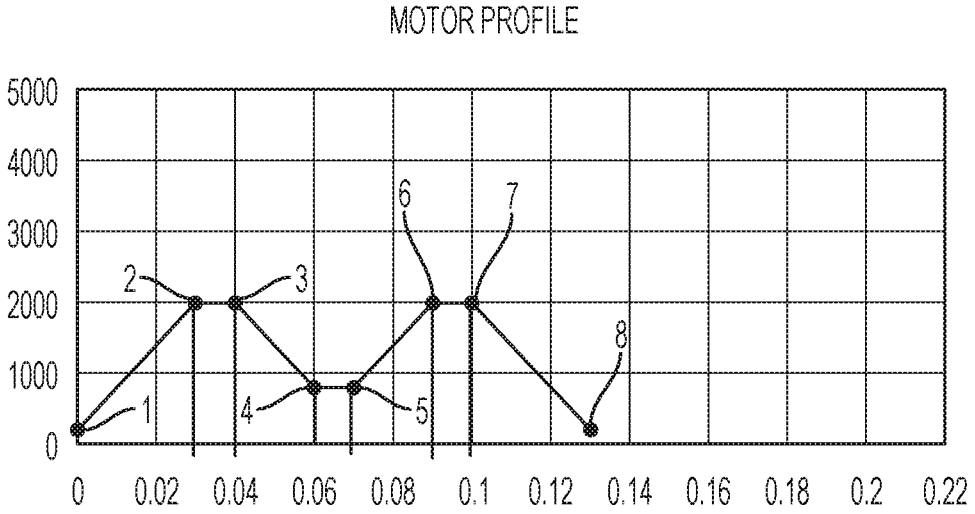
FIG. 6A to FIG. 6D illustrates different candidate waveforms for actuator profiles that can be used to drive the actuator of the TAB mechanism in FIG. 2.
Figure 6B:
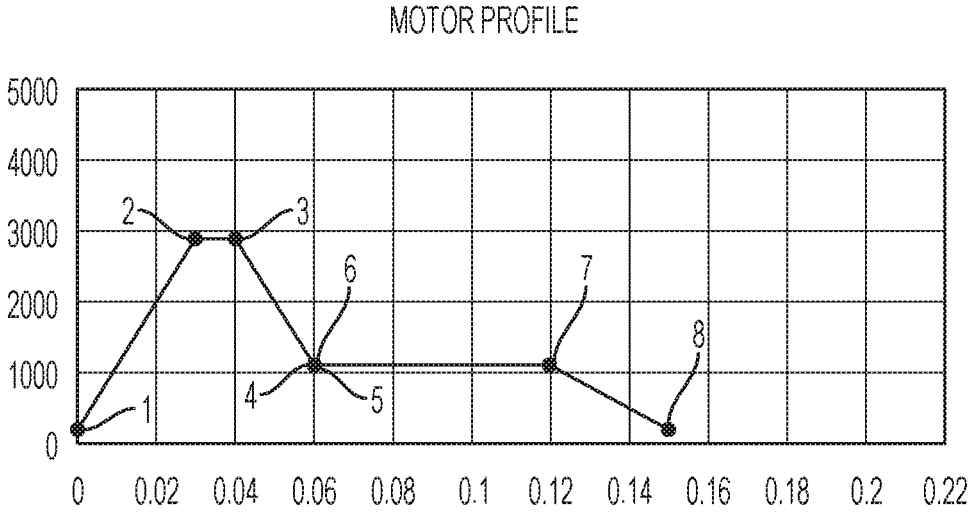
Figure 6C:
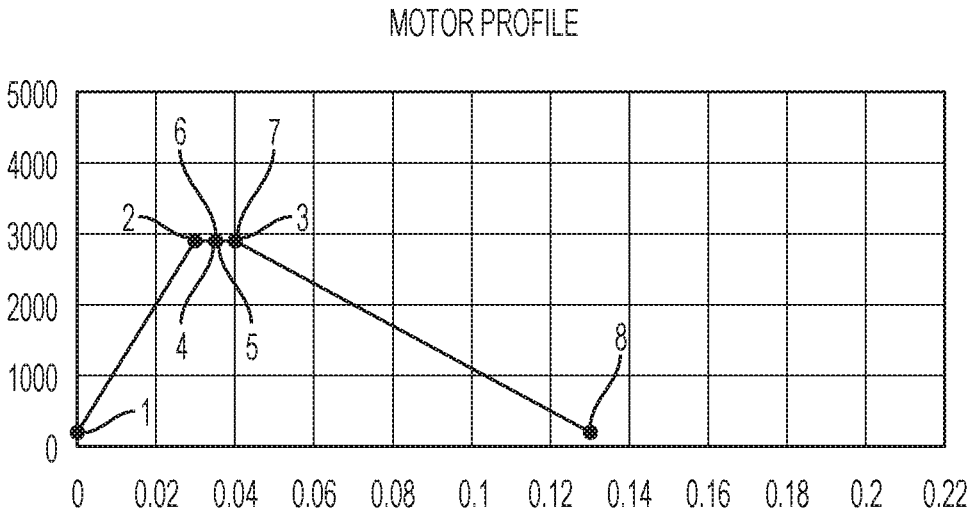
Figure 6D:
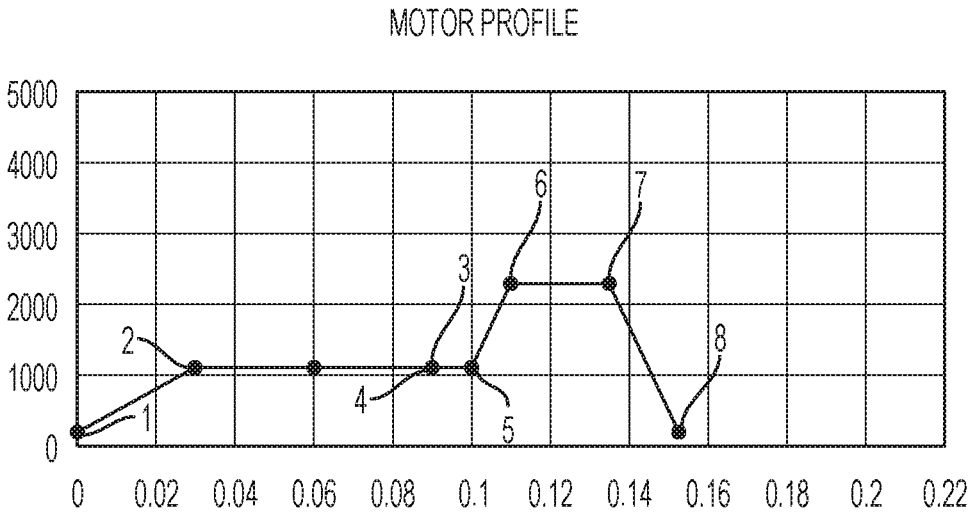

FIG. 5B and FIG. 5C show the new controller operating the actuator in the prior art TAB mechanism used in FIGS. 8B and 8C in the LE deletion optimization mode for A4 size paper and 8"×10" size paper at a speed of 157 ppm. The pulse trains forming waveform 312'" shown in FIG. 5A are similar with the following exceptions. In FIG. 5B, the dip in pulse train 320" accommodates the longer IDZ and the later commencement of the TAB application to sheet 2. Similarly, the dip near the mid-point of the pulse train 320" in FIG. 5C holds the TAB off an even longer IDZ while preserving the landing position of the TAB on sheet 2 at the quicker landing rate of the LE deletion mode.

As can be seen from FIG. 3A to FIG. 5C, the controller selecting the new profiles with reference to the parameters of a print job consistently lands and retracts the TAB at appropriate locations on the sheets, while precisely controlling the rates of landing, pressure application, and retraction. Thus, a controller configured to access the look-up tables stored in the memory in correspondence with print job parameters provides new and improved control of a TAB through a single drive train.

A set of actuator profiles are shown in FIG. 6A, FIG. 6B, FIG. 6C, and FIG. 6D. Each of the waveforms depicted in these profiles can be viewed as having seven segments. In some of the figures, some of the segments overlap so that they are not distinguishable in the waveform since they collapse into one another. For example, the general waveform shown in FIG. 6A clearly has seven distinguishable segments, while the waveforms of FIG. 6B and FIG. 6C appear to have five and three segments, respectively. As indicated by the numbers 1-8 in the figures, however, the segments that have collapsed into a single segment can be identified. Each of the waveform segments is capable of defining a length of time at which the actuator receives control pulses at a predetermined pulse rate. The number of pulses that the actuator can receive during a single waveform is limited to a predetermined number of pulses that rotates the output shaft of the actuator through a single revolution. In one embodiment, the total number of pulses associated with each waveform shown in FIG. 6A to FIG. 6D is 200 pulses.

Figure 9:
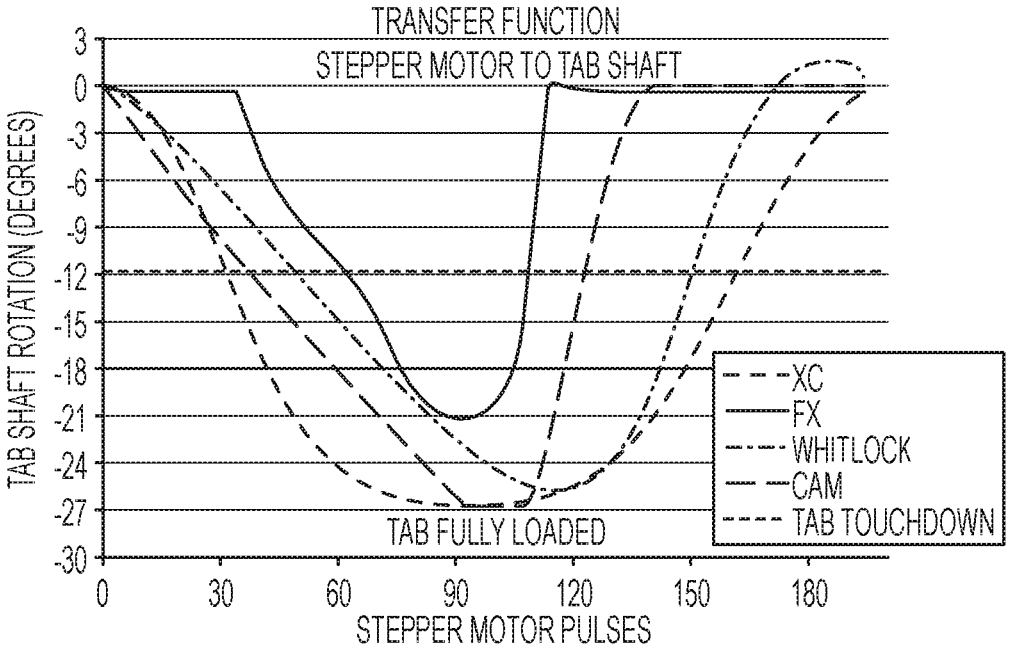
FIG. 9 PRIOR ART
FIG. 9 is graph of known drive train responses to an actuator being driven by a known drive waveform.

To develop the actuator profiles for a particular drive train, the transfer function between the motor shaft position and the corresponding transfer assist mechanism response must be mapped for one particular drive train as illustrated by any one of the four cases shown in FIG. 9. The resulting transfer function provides the knowledge of the chosen TAB mechanism position as a function of any stepper motor position needed to develop the actuator profiles. A mechanical simulation can be performed with a software simulator, such as the Recurdyn multi-body dynamics computer-aided engineering (CAE) software available from Siemens. By varying the pulse rates for the different segments of a candidate waveform, the rotation of the TAB from contact on a substrate to lift off for an IDZ and return to contact on the next substrate can be simulated to determine the proper candidate waveform and pulse rates needed to meet the operational parameter goals associated with any combination of selected media type, substrate speed, and pitch mode. The data identifying the pulse rates and the transition times are stored in a look-up table stored in a memory operably connected to the controller. During the printing process, the process speed, substrate size, image design, and media type can be reference to select the proper motor drive parameters to render overall print quality optimal for identified parameters. Thus, the actuator profiles provide a virtual parametric drive train for the mechanism.

A refinement of the profile section process described above is implemented with the user interface 68 previously described. The interface 68 includes a menu that enables an operator to make some simple tradeoffs in light of competing TAB operation requirements for a print job. In one implementation, the speed modes are broadly defined as "slow," "fast," and "medium slow." These speeds refer to the speed of the TAB during rotation down onto the sheets. In one embodiment of the GUI used to implement this refinement, each operational mode identified in FIG. 3A to FIG. 5C has two speeds with one speed corresponding to the speed of the TAB as it lifts off a substrate and the other speed corresponds to the speed of the TAB as it moves to engage the substrate. In other embodiments of the GUI, additional speeds and TAB application forces could be defined for one or more of the operational modes. The actuator profiles associated with these speeds are also stored in the memory operably connected to the controller and the data for these profiles are determined with the simulation software as described earlier. If a printer operator detects that the deletion rate for a substrate speed sent with a print job is unacceptable, then the operator can select one of the "medium slow" or "slow" speeds with the user interface to see if an alternative speed appropriately addresses the issue. Similarly, if an operator thinks a faster speed for a print job can be done without producing image issues, the operator can use the user interface to identify a faster speed for the print job and the controller accesses the actuator profile data for the operator defined speed, media type, and pitch mode for sending pulses to the actuator.

Figure 7:
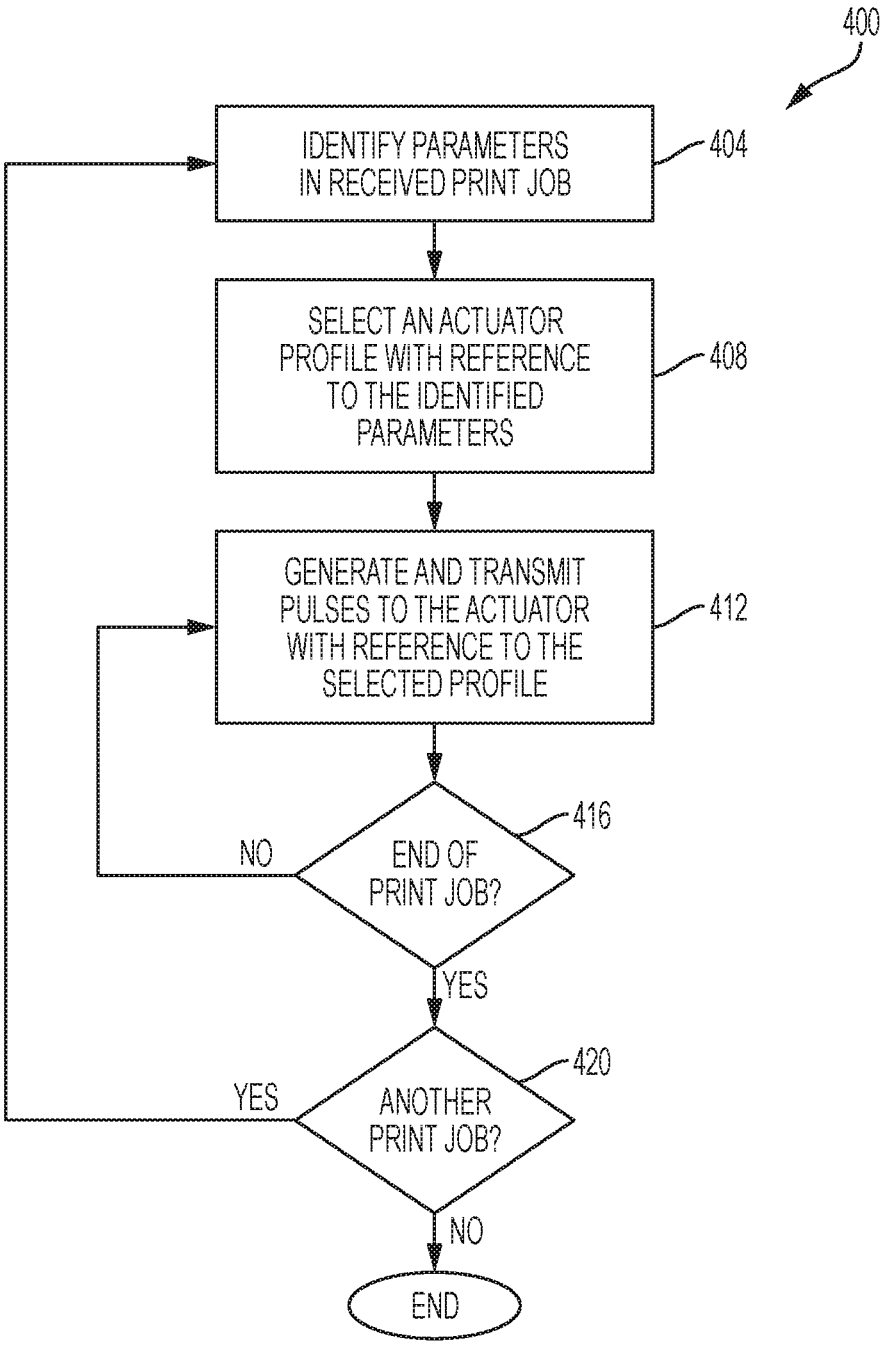
FIG. 7 is a flowchart of an exemplary method for operating a TAB mechanism in the electrostatographic machine of FIG. 1

A process 400 for operating a TAB with different actuator profiles is shown in FIG. 7. After receiving a print job, the controller identifies the substrate speed, media type, and pitch mode as well as any operator speed inputs entered through the interface as discussed above (block 404) and accesses the corresponding actuator profile data (block 408). The controller uses the actuator profile data to generate actuator pulses that are transmitted to the actuator to rotate the output shaft of the actuator through a single revolution (block 412). During this single revolution of the output shaft, the TAB rotates from contact on a substrate to lift off for an IDZ and then returns to contact on the next substrate. By repeating the process of generating and transmitting the actuator pulses corresponding to the stored data for the identified parameters until the end of the print job (block 416), the TAB mechanism is efficiently operated throughout the print job for the identified parameters. When another print job is sent to the printer (block 420), the controller repeats the process and accesses the actuator profile data for the parameters associated with the new print job and operates the actuator with reference to the actuator profile.

While various exemplary embodiments have been described and illustrated, the reader should understand that many alternatives, modifications and variations would be apparent to those skilled in the art. Accordingly, Applicants intend to embrace all such alternatives, modifications and variations that follow in the spirit and scope of this disclosure.

What is claimed is:

1. An apparatus for assisting transfer of an image to media in a printer comprising:
- a member;
- a drive train configured to move the member;
- an actuator operably connected to the drive train; and
- a controller operably connected to the actuator, the controller being configured to:
  - compare an amount of marking material in the image near a leading edge of the media to a predetermined threshold;
  - select an actuator profile stored in a memory operably connected to the controller with reference to the amount of marking material exceeding the predetermined threshold, the actuator profile having a waveform for operating the actuator; and
  - transmit a plurality of pulse trains to the actuator with reference to the selected actuator profile to rotate an output shaft of the actuator to operate the drive train and move the member.

2. The apparatus of claim 1 wherein the member is a transfer assist blade.

3. The apparatus of claim 1 further comprising:
- a user interface operably connected to the controller, the user interface being configured to enable an operator to identify a speed of the member; and
- the controller is operably connected to the user interface to receive the identification of the speed of the member, the controller being further configured to select the actuator profile with reference to the identified speed of the member or the length of the inter-document zone.

4. The apparatus of claim 3 wherein the identification of the member speed includes identification of the speed of the member as the member contacts the substrate and identification of the speed of the member as the member lifts from the substrate.

5. The apparatus of claim 3 wherein each actuator profile in the plurality of actuator profiles corresponds to an operational mode in a plurality of operational modes.

6. The apparatus of claim 5 wherein the plurality of operational modes includes a nominal mode, a leading edge smear mode, and a leading edge deletion mode.

7. An apparatus for assisting transfer of an image to media in a printer comprising:
- a member;
- a drive train configured to move the member;
- an actuator operably connected to the drive train; and
- a controller operably connected to the actuator, the controller being configured to:
  - select an actuator profile stored in a memory operably connected to the controller with reference to a length of an inter-document zone between images, the actuator profile having a waveform for operating the actuator; and
  - transmit a plurality of pulse trains to the actuator with reference to the selected actuator profile to rotate an output shaft of the actuator to operate the drive train and move the member.

8. An apparatus for assisting transfer of an image to media in a printer comprising:
- a member;
- a drive train having a cam operably connected to the member;
- an actuator operably connected to the cam; and a controller operably connected to the actuator, the controller being configured to:

select an actuator profile from a plurality of actuator profiles stored in a memory operably connected to the controller with reference to at least one print job parameter, the at least one print job parameter being one of a print substrate type, a substrate speed, and a pitch mode, each actuator profile having a waveform for operating the actuator and each actuator profile in the plurality of actuator profiles is configured to lift off the media at a predetermined position corresponding to the print substrate type and to land on the media at a predetermined position corresponding to the print substrate type; and transmit a plurality of pulse trains to the actuator with reference to the selected actuator profile to rotate an output shaft of the actuator to rotate the cam and move the member in response to the pulses received by the actuator from the controller.

9. A method for operating a transfer assist blade apparatus in a printer comprising:

receiving from a user interface operably connected to a controller a speed of a member as the member contacts a substrate and a speed of the member as the member lifts from the substrate;

selecting with the controller an actuator profile stored in a memory operably connected to the controller with reference to the received speed of the member as the member contacts the substrate and the received speed of the member as the member lifts from the substrate, the actuator profile having a waveform for rotating an output shaft of an actuator to operate a drive train and move the member; and transmitting with the controller a plurality of pulse trains to the actuator with reference to the waveform of the selected actuator profile.

10. A method for operating a transfer assist blade apparatus in a printer comprising:

selecting with a controller an actuator profile stored in a memory operably connected to the controller with reference to one of a nominal operational mode, a leading edge smear optimization operational mode, and a leading edge deletion optimization operational mode, the actuator profile having a waveform for rotating an output shaft of an actuator to operate a drive train and move a transfer assist blade; and transmitting with the controller a plurality of pulse trains to the actuator with reference to the waveform of the selected actuator profile.

11. The method of claim 10 wherein the rotation of the output shaft of the actuator operates the drive train to move a transfer assist blade.

12. The method of claim 11 wherein the rotation of the output shaft of the actuator rotates a cam in the drive train to move the transfer assist blade.

13. The method of claim 11 wherein the rotation of the output shaft of the actuator rotates a gear in the drive train to move the transfer assist blade.

* * * * *